US006768803B1

(12) United States Patent
Duhamel

(10) Patent No.: US 6,768,803 B1
(45) Date of Patent: Jul. 27, 2004

(54) METHOD AND APPARATUS FOR SELECTIVE ACOUSTIC SIGNAL FILTERING

(75) Inventor: Gilles Duhamel, St-Bruno (CA)

(73) Assignee: Sonomax Hearing Healthcare Inc, Montreal (CA)

( * ) Notice: Subject to any disclaimer, the term of this patent is extended or adjusted under 35 U.S.C. 154(b) by 0 days.

(21) Appl. No.: 09/528,384

(22) Filed: Mar. 20, 2000

(51) Int. Cl.[7] ..... H04R 25/00

(52) U.S. Cl. ..... 381/372; 381/380; 381/72; 181/132; 181/135

(58) Field of Search ..... 381/72, 372, 380, 381/371, 370, 328; 181/135, 129, 130, 132, 134; 128/864, 867, 868

(56) References Cited

U.S. PATENT DOCUMENTS 3,565,069 A * 2/1971 Miller ..... 128/867
3,842,829 A * 10/1974 Ellis ..... 128/868
4,353,364 A * 10/1982 Woods ..... 128/867
5,018,203 A 5/1991 Sawyers et al.
5,241,512 A 8/1993 Argy et al.
5,371,801 A 12/1994 Powers et al.
5,740,258 A * 4/1998 Goodwin-Johansson ..... 381/72
5,812,684 A 9/1998 Mark

* cited by examiner

*Primary Examiner*—Minsun Oh Harvey
*Assistant Examiner*—Brian Pendleton

(57) ABSTRACT

The present invention relates to a method and apparatus for performing selective acoustic signal filtering. The apparatus comprises two acoustic ports, an electrical output port and an acoustic signal processing device, where all three ports have an impedance characteristic. The acoustic signal processing device includes a diaphragm which will manifest vibration in response to an admitted input acoustic signal and generates an output acoustic signal. The signal processing device is characterized by a frequency response such that the spectrum level of the output acoustic signal will have predetermined differences with respect to the input acoustic signal. The frequency response characteristic of the signal processing device may be set and adjusted by the manipulation of the impedance characteristics of either the acoustic output load or the electrical output load.

13 Claims, 1 Drawing Sheet

METHOD AND APPARATUS FOR SELECTIVE ACOUSTIC SIGNAL FILTERING

FIELD OF THE INVENTION

This invention relates to the field of acoustic signal processing and more specifically to acoustic signal filtering. It is particularly useful in hearing protection applications, for instance a noise protection ear plug, where a tradeoff exists between the level of hearing protection and the ease of communication.

BACKGROUND OF THE INVENTION

Every day, people in all types of different situations are exposed to sound. This sound may range in quality, from quiet and soothing to loud and disturbing. Sound is caused by vibrations. When a person speaks, air is forced across the vocal cords causing them to vibrate. Similarly, the speakers in a stereo system vibrate to produce sound.

The "sound" can be defined as alterations in air pressure that are perceived by hearing organs with respect to time. These alterations consist in changes in the air pressure from a low pressure zone, low density of air molecules, to a high pressure zone, high density of air molecules, and vice versa. As an example, in a quiet room with no perceivable sound there exists a steady-state of air pressure as registered by the hearing organ. When a sound is generated, alterations in the steady-state air pressure are created. If the sound originates from a loudspeaker, the diaphragm of the loudspeaker moves outward compressing the molecules of air, creating a high pressure zone. Immediately following this, the speaker diaphragm is moved inward resulting in a rarefaction of the air molecules. This action creates the low pressure zone that follows the high pressure zone.

Sound travels via the process of molecules of air interacting with each other, thus transferring their energy from one molecule to the next. The radiation of sound implies an energy transfer through the molecules of air, resulting in a moving high pressure (compression) zone traveling at 1130 feet/second.

Two important points should be noted, relevant to the field of acoustics, which arise in a variety of different situations particularly those involving speech:

- the need to extract, and possibly amplify, one particular component of a sound, for instance a voice signal superimposed with noise;
- the need to attenuate a particular sound, for purposes of hearing protection, environment control and others, in situations where the characteristics of pitch, intensity and timbre of the sound are uncontrollable and unfavorable.

An existing solution is the acoustic filter. An acoustic filter is a device usually employed to reject or attenuate sound in a particular range of frequencies, while passing sound in another range of frequencies. One example of the use of such a device is within noise protection ear plugs, used to attenuate surrounding noise, whereby the acoustic filter attenuates a desired portion of the sound spectrum in order to facilitate speech reception.

Unfortunately, existing acoustic filter applications, specifically those directed to hearing protection, do not address the tradeoff between fidelity of communication and the level of hearing protection. This constitutes a drawback that the present invention aims to alleviate.

OBJECTS AND STATEMENT OF THE INVENTION

An object of this invention is to provide an improved acoustic signal filter.

Another object of this invention is to provide a novel method for performing selective acoustic signal filtering.

As embodied and broadly described herein, the invention provides an acoustic signal shaping device, comprising:

- an input port for receiving an input acoustic signal to be processed;
- an acoustic signal processing device for producing an output acoustic signal in response to the input acoustic signal, said acoustic signal processing device including:
  1) a diaphragm within a path of propagation of the input acoustic signal, said diaphragm manifesting vibration in response to interaction with the input acoustic signal to generate the output acoustic signal;
  2) said acoustic signal processing device characterized by a frequency response such that the output acoustic signal spectrum level manifests predetermined differences with respect to the input acoustic signal spectrum level;
- an output port for releasing the output acoustic signal produced by said acoustic signal processing device.

In a specific example, the acoustic signal shaping device forms an acoustic filter used in a noise protection ear plug. The filter is able to provide an acoustic shunt to reduce the ear protector's attenuation in a desired portion of the sound spectrum. This is to facilitate speech reception while maintaining the desired noise protection characteristic of the ear plug.

The acoustic filter comprises two acoustic ports, and an acoustic signal processing device. The acoustic input port receives the input acoustic signal in the form of sound waves, while the acoustic output port releases the output acoustic signal from the filter. The acoustic signal processing device itself comprises an acoustic diaphragm that vibrates when exposed to the input acoustic signal. In addition, the acoustic signal processing device includes an energy dissipation component that is magnetically, coupled to the diaphragm. More specifically, the diaphragm is structurally coupled to a permanent magnet and causes this magnet to oscillate when the diaphragm vibrates. In turn, this creates an oscillating magnetic field. In a specific example, the energy dissipation component is an electrical circuit behaving as a passive filter. Such passive filter could be a band stop filter. The electrical circuit includes an inductor located in proximity to the permanent magnet to capture the oscillating magnetic field. This oscillating magnetic field induces a an oscillating electrical current in the resonant circuit. When the frequency at which the diaphragm vibrates is close or is the same as the resonant frequency of the resonant circuit, an energy transfer occurs between the diaphragm and the resonant circuit. As a result, the diaphragm will pass the energy contained in the input acoustic signal in this frequency range to the resonant circuit, rather than in the output acoustic signal. This mechanism provides the filtering or sound conditioning behaviour of the acoustic filter.

The signal conditioning properties of the acoustic filter can be varied by altering the response characteristics of the energy dissipation component. This provides the acoustic filter with adjustability.

As embodied and broadly described herein, the invention provides a method for performing selective acoustic signal filtering, said method comprising the steps of:

- receiving an input acoustic signal;
- exposing a diaphragm to the input acoustic signal to induce vibrations in said diaphragm, the vibrations causing generation of an output acoustic signal;

controlling a vibration characteristics of said diaphragm such that the output acoustic signal spectrum level manifests predetermined differences with the input acoustic signal spectrum level;

releasing the output acoustic signal.

As embodied and broadly described herein, the invention further provides an acoustic filter, comprising a diaphragm having a first face and a second face, said first face being exposed to an input acoustic signal to be processed, said diaphragm manifesting vibration in response to interaction with the input acoustic signal to generate the output acoustic signal at said second face;

a magnet coupled to said diaphragm for moving with said diaphragm when said diaphragm manifests vibration, thereby causing generation of a fluctuating magnetic field;

an energy dissipation device including an electrical coil located in the fluctuating magnetic field to generate in response to the fluctuating magnetic field a variable electric signal, said energy dissipation device being capable of attenuating the electric signal at a level depending upon a frequency of said electric signal.

BRIEF DESCRIPTION OF THE DRAWINGS

These and other features of the present invention will become apparent from the following detailed description considered in connection with the accompanying drawings. It is to be understood, however, that the drawings are provided for purposes of illustration only and not as a definition of the boundaries of the invention, for which reference should be made to the appending claims.

DESCRIPTION OF A PREFERRED EMBODIMENT

Figure 1:
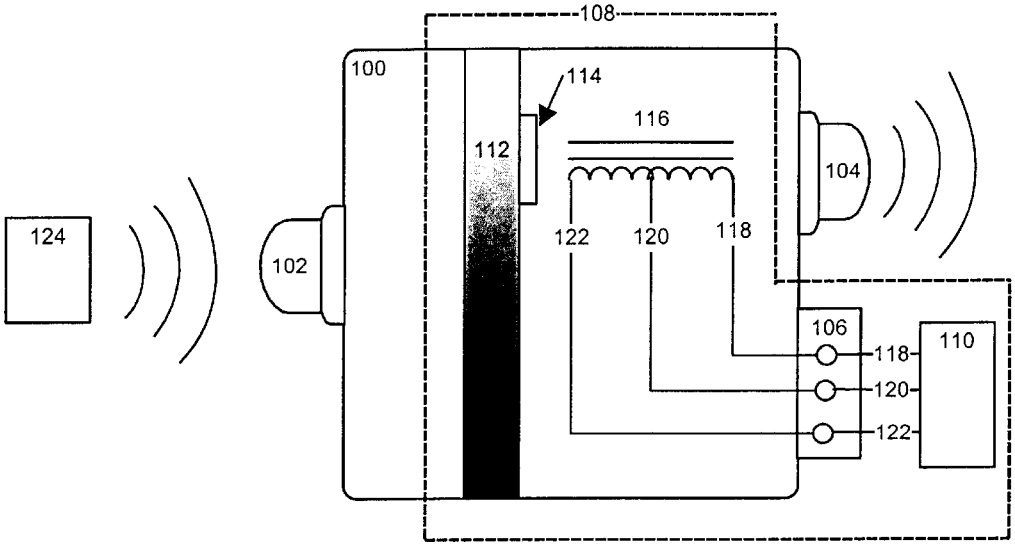
FIG. 1 is a block diagram of an acoustic filter, in accordance with this invention.

The structure of an acoustic filter constructed in accordance with the present invention is illustrated in FIG. 1 of the drawings. The novel acoustic filter is designed to be placed in an ear canal to condition the sound waves captured by the ear. In a specific example, the purpose of this conditioning operation is to reject or at least attenuate the sound for a certain frequency range. The novel acoustic filter design shares a number of components with a standard hearing aid receiver. Such a receiver is normally a simple transducer, used to convert received electrical signals into acoustic signals. This role is similar to that of a loudspeaker, as is the receiver's structural make-up, which comprises mainly a miniaturised coil, an acoustic diaphragm and an output port. Since both the design and functionality of a standard hearing aid receiver are well documented and known to those skilled in the art, they will not be described in more detail.

FIG. 1 is a block diagram of the most preferred embodiment of the acoustic filter. Specific to this example, the acoustic filter 100 comprises two acoustic ports 102 and 104, and an acoustic signal processing device 108. The acoustic signal processing device 108 provides for a third port, electrical port 106. The external source 124 generates the acoustic signals to be filtered, and may consist in a piece of machinery, noise, a person speaking, or any other source of acoustic signals. Both acoustic ports, 102 and 104, can serve as either input or output port; however, in the interest of clarity, port 102 will be assumed to be the acoustic input port, and port 104 the acoustic output port. Therefore, the input port 102 receives an input acoustic signal, or sound waves, which arrive at the filter for processing, while the output port 104 releases an output acoustic signal from the filter. Port 106 is an electrical port, to be described in more detail below.

The acoustic filter can be implemented on a standard hearing aid receiver platform. In a specific example, a standard hearing aid receiver, model number FC331912C, manufactured and commercialised by the American company Knowles Electronics, was modified to add the features not found in the prior art.

The acoustic diaphragm 112, combined with the two acoustic ports 102 and 104, provide an acoustic path of propagation through the device for receiving and transmitting acoustic signals. Thus, an input acoustic signal entering the filter through the input port 102 interacts with the diaphragm 112 and causes that diaphragm to vibrate. The mechanical vibrations give rise to the output acoustic signal that is released from the output port 104. The acoustic signal processing device 108 includes, further to the acoustic diaphragm 112, a permanent magnet 114, a collection of passive electrical components 110 and an induction coil 116, the latter of which is already the transducer component of the standard hearing aid receiver. The magnet 114 is coupled to the acoustic diaphragm 112 to permit the generation of an electrical output at the terminals 118, 120 and 122 of the induction coil 116 as a function of the diaphragm's movement. Specifically, the acoustic sound pressure level from the input acoustic signal arriving at the input port 102 activates the diaphragm 112, which manifests movement through vibration in response. This movement delivers acoustic energy to the acoustic output port 104 and simultaneously creates an oscillating magnet field picked-up by the induction coil 116.

The electrical output port 106 includes electrical terminals 118, 120 and 122, permitting the connection to an external energy dissipation device in the form of electrical load 110. Alternatively, this electrical load could be internal to the filter 100, in other words built-in the filter casing. The electrical output generated at the coil 116 is fed directly through terminals 118, 120 and 122 to the electrical load 110. This load may include resistors, capacitors and any other passive electrical component(s) connected to form a resonant circuit. In an alternative embodiment of this invention, the electrical load 110 could also include active circuitry.

The purpose of the electrical load 110 is to act as an energy shunt, whereby the coil 116 dissipates energy through the connected load of components. The electrical load has a frequency response which determines the filtering or sound conditioning behaviour of the filter. For example, when the electrical load is a band stop filter, the filter will attenuate the acoustic signal in the frequency range corresponding to frequency admittance band of the electrical load 110. Thus, when the input signal has a frequency that is within the frequency admittance band, the energy of the input signal is dissipated in the electrical load 110 rather than being passed to the output port. The output acoustic signal will then manifest a difference relative to the input acoustic signal that is the absence or reduction of sound in the frequency admittance band of the electrical load. By varying the frequency response of the electrical load 110, the desired filtering or conditioning effect can be provided.

The discrimination characteristics of the acoustic filter 100 with frequency, or its frequency response, may be characterized using an insertion loss method of measurement. This typically consists of first establishing a baseline reference measurement for an acoustic signal source when it is connected directly to a normal output load, in absence of the device to be tested. Subsequently, the device to be tested is inserted between the acoustic signal source and the same output load, and a new measurement taken. The difference between the two measurements is the insertion loss attributes of the tested device. As a result of the influence of the electrical load at output port 106 on the insertion loss between the two acoustic ports 102 and 104, these ports may be adjusted to vary with frequency, permitting a wide range of frequency response characteristics to be established by the acoustic signal processing device 108. Consequently, the acoustic filter 100 may be adjusted to a high-pass filter, a band-pass filter, a band-stop filter, as well as other acoustic filter responses.

As described above, the acoustic diaphragm 112 will manifest vibrations in response to the acoustic signal spectrum level it admits. The changes in the impedance characteristics of either the acoustic output 104 load or the electrical output 106 load will affect the acoustic diaphragm's admittance or reflection of acoustic energy presented to it. Note that the energy level of an acoustic signal originating from some external source 124 and presented at the acoustic input port 102 of the filter 100 will result in a somewhat reduced energy level upon propagation to the acoustic diaphragm 112 as a result of the input insertion loss.

Figure 2:
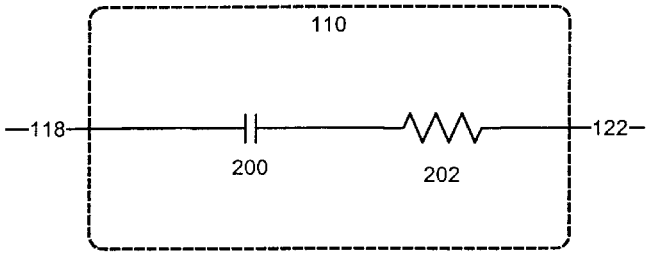
FIG. 2 is a circuit diagram of an energy dissipation component, located within the acoustic signal processing device of the acoustic filter shown in FIG. 1.

Assume for the purpose of the following simple example that the acoustic diaphragm 112 does not block low frequency acoustic signals arriving via the input port 102. FIG. 2 is a circuit diagram of a sample electrical load 110 that could be used within the acoustic signal processing device 108 to define a particular frequency response characteristic. In this example, the load 110 is a circuit including a capacitor 200 and a resistor 202. Recalling that the impedance Z of a capacitor C varies with frequency as per the relationship Z=1/jwC, it is clear that as w approaches 0, Z will approach ¥, and as w approaches ¥, Z will approach 0. Therefore, for low frequency acoustic signals, the load 110 will act as an open-circuit, as a result of the infinite impedance of the capacitor 200, and will not act as an energy shunt for the coil 116. On the other hand, for high frequency acoustic signals, the negligible impedance of the capacitor 200 will allow the coil to dissipate energy through the load 110, more specifically through resistor 202. Therefore, the frequency response characteristic of the filter 100 will be similar to that of a low-pass filter, as the energy from low frequency acoustic signals will not be dissipated through the load 110, but rather will be available to the diaphragm 112 for the generation of output acoustic signals.

It has been observed that the permanent magnet 114 also acts as a diaphragm tensor mechanism, and is responsible for providing direct or indirect tension of the diaphragm 112 in order to reduce signal level inter-modulation acoustic distortion during the filter's operation, thus ensuring coherent sound and fidelity of communication. Alternatively, a direct current source could generate the necessary magnetic field to provide tension to the diaphragm, among other alternatives, all of which are included within the scope of this invention. This can be achieved by connecting the coil 116 to a source of DC current to produce a magnetic field of the desired intensity, capable to tension the diaphragm 112 as desired.

Concerning hearing protection applications, the acoustic filter 100 is to be used within a noise protection ear plug. In such an application, the acoustic filter's acoustic output port 104 is facing the eardrum while the acoustic input port 102 is acoustically connected to the outside of the earplug. Through the choice of particular types and values of passive electrical components for the filter's electrical load 110, the filter is able to provide an acoustic shunt to reduce the ear protector's attenuation in a desired portion of the sound spectrum.

In another example, several acoustic filters could be installed, either randomly or following a predetermined layout, in a panel or wall to provide sound filtration on a larger scale. Such a panel could be used, for example, to isolate one area within a large machinery room, the filters within the panel characterized by a frequency response intended to selectively attenuate a particular range of the sound spectrum, while admitting another range. In this example, the same basic structure is used except that the components are not mounted in a casing. The panel itself acts as a diaphragm. The panel can be provided with a permanent magnet that is caused to move as the panel vibrates in response to the input acoustic signal. A support structure locates the pick-up coil in proximity to the permanent magnet to enable an energy transfer in the desired frequency.

In yet another example, the acoustic filter could be used in an application for hearing protection, specifically an application for passive hearing correction in the case of a slight loss of hearing. In this example, the same basic structure as described above for the acoustic filter is used, whereby the filter components are all mounted in a casing. In addition, an acoustic shunt with built-in acoustic resistors will be mounted externally on the casing. This external acoustic shunt will allow the instrument to discriminate and reach a balance between incoming low and high acoustic signal frequencies, necessary to passive hearing correction.

Although the present invention has been described in considerable detail with reference to certain preferred embodiments thereof, variations and refinements are possible without departing from the spirit of the invention as have been described throughout the document. Therefore, the scope of the invention should be limited only by the appended claims and their equivalents.

I claim:

1. An acoustic filtering device, comprising:

an input port for receiving an input acoustic signal to be processed;

an acoustic signal processing device for producing an output acoustic signal in response to the input acoustic signal, said acoustic signal processing device including:

a) a diaphragm within a path of propagation of the input acoustic signal, said diaphragm manifesting vibration in response to interaction with the input acoustic signal to generate the output acoustic signal;

b) said acoustic signal processing device characterized by a frequency response such that the output acoustic signal spectrum level manifests predetermined differences with the input acoustic signal spectrum level;

c) an energy dissipation device coupled to said diaphragm to inhibit vibratory movement of said diaphragm at a certain frequency;

an acoustic output port for releasing the output acoustic signal produced by said acoustic signal processing device.

2. An acoustic filter as defined in claim 1, wherein said energy dissipation device is magnetically coupled to said diaphragm to inhibit vibratory movement of said diaphragm at the certain frequency, thereby reducing an intensity of the output signal at the certain frequency.

3. An acoustic filter as defined in claim 2, including a magnet mounted to said diaphragm, vibration of said diaphragm causing said magnet to move and generate a fluctuating magnetic field.

4. An acoustic filter as defined in claim 3, wherein said energy dissipation device includes a coil mounted in proximity to said magnet for sensing the fluctuating magnetic field.

5. An acoustic filter as defined in claim 4, wherein said energy dissipation device is capable to dissipate energy at a rate that is function of a frequency at which said diaphragm vibrates.

6. An acoustic filter as defined in claim 4, wherein said energy dissipation device is an electrical load.

7. An acoustic filter as defined in claim 5, wherein an impedance of said electrical load varies with a frequency of an electric signal induced in said coil.

8. An acoustic filter as defined in claim 7, wherein said electrical load includes passive electrical components.

9. An acoustic filter as defined in claim 1, wherein said diaphragm includes an aperture forming an air leakage path for providing atmospheric pressure change equilibrium between said input port and said output port.

10. An acoustic filter as defined in claim 1, wherein said acoustic filter has a dimension suitable for entering an ear canal.

11. A method for performing selective acoustic signal filtering, said method comprising the steps of:

receiving an input acoustic signal;

exposing a diaphragm to the input acoustic signal to induce vibrations in said diaphragm, the vibrations causing generation of an output acoustic signal;

controlling a vibration characteristics of said diaphragm such that the output acoustic signal spectrum level manifests predetermined differences with the input acoustic signal spectrum level;

releasing the output acoustic signal.

12. A method as defined in claim 11, comprising the step of inhibiting vibratory movement of said diaphragm at a selected frequency, thereby reducing an intensity of the output signal at the selected frequency.

13. An acoustic filter, comprising:

a diaphragm having a first face and a second face, said first face being exposed to an input acoustic signal to be processed, said diaphragm manifesting vibration in response to interaction with the input acoustic signal to generate the output acoustic signal at said second face;

a magnet coupled to said diaphragm for moving with said diaphragm when said diaphragm manifests vibration, thereby causing generation of a fluctuating magnetic field;

an energy dissipation device including an electrical coil located in the fluctuating magnetic field to generate in response to the fluctuating magnetic field a variable electric signal, said energy dissipation device being capable of attenuating the electric signal at a level depending upon a frequency of said electric signal.

* * * * *